US005492604A

United States Patent [19]

Ray

[11] Patent Number: 5,492,604

[45] Date of Patent: Feb. 20, 1996

[54] COATING COMPOSITION FOR CARBON ELECTRODES

[75] Inventor: Siba P. Ray, Murrysville, Pa.

[73] Assignee: Aluminum Company of America, Pittsburgh, Pa.

[21] Appl. No.: 364,918

[22] Filed: Dec. 28, 1994

[51] Int. Cl.[6] ..... C25C 3/04; C25C 3/06; C25C 3/08

[52] U.S. Cl. ..... 205/373; 205/379; 205/384

[58] Field of Search ..... 204/64 R, 67, 204/70, 290 R

[56] References Cited

U.S. PATENT DOCUMENTS 4,466,996 8/1984 Boxall et al. ..... 204/67
5,019,225 5/1991 Darracq et al. ..... 204/67
5,310,476 5/1994 Sekhar et al. ..... 205/230
5,352,338 10/1994 Juric et al. ..... 204/67
5,364,513 11/1994 Sekhar et al. ..... 204/290 R

*Primary Examiner*—Kathryn Gorgos
*Attorney, Agent, or Firm*—Glenn E. Klepac

[57] ABSTRACT

A method for producing a metal in an electrolysis cell comprising an anode, a carbon cathode, and a chamber containing a metal oxide dissolved in a molten salt bath, said method comprising: coating an outer surface portion of the cathode with a coating composition consisting of a refractory metal, a paint comprising an organic polymeric binder, and aluminum powder, and optionally an organic solvent and an oil; and optionally a boron source; curing the coating composition by heating it to an elevated temperature, producing an aluminum-wettable coating on the cathode outer surface portion; and electrolyzing the metal oxide to a metal bypassing an electric current in the molten salt bath between the anode and the coated cathode.

16 Claims, 1 Drawing Sheet

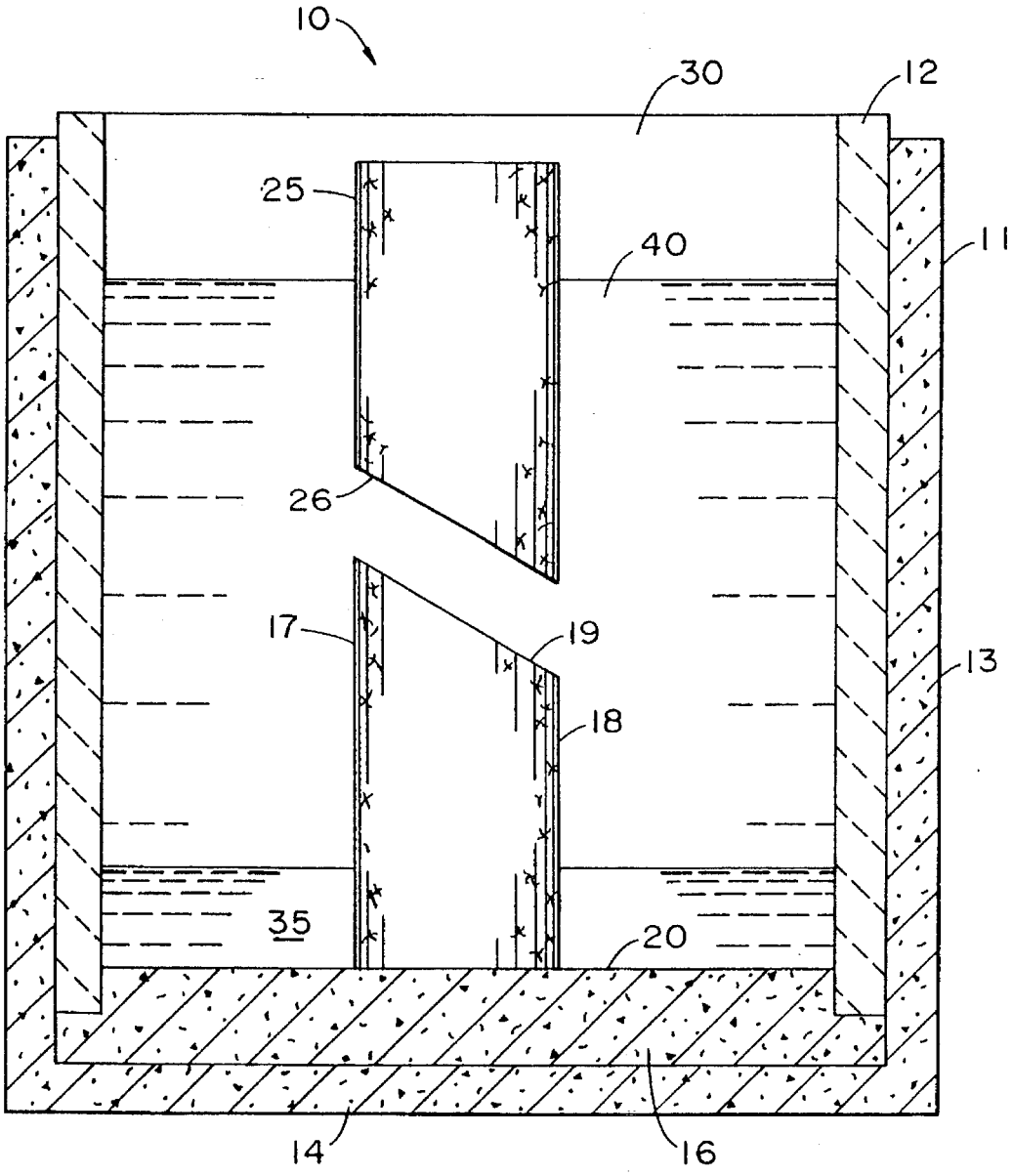
10
30
12
25
40
11
26
17
19
13
18
35
20
14
16

COATING COMPOSITION FOR CARBON ELECTRODES

FIELD OF THE INVENTION

The present invention relates to a coating composition for providing a metal-wettable coating on carbon electrodes used in the electrolytic production of metals from metal oxides dissolved in a molten salt bath. More particularly, the composition is coated onto carbon cathodes used for the electrolytic production of aluminum from aluminum oxide.

BACKGROUND OF THE INVENTION

In the Hall-Heroult process, aluminum is extracted by electrolyzing aluminum oxide (also known as "alumina") dissolved in a molten salt bath based on an electrolyte containing primarily sodium fluoride and aluminum fluoride. The molten electrolyte is generally maintained at a temperature in the range of about 950° C.–1000° C. The electrolytic cell includes a crucible having a carbon lining which serves as the cathode, and anodes, typically carbon, immersed in the molten salt bath.

The molten salt-aluminum oxide serves as an electrolyte solution. Heat produced by the large electric current in the cell melts the cryolite which dissolves the aluminum oxide and maintains the electrolyzed aluminum in a molten state in which it collects at the cell bottom.

Although the Hall-Heroult process has been commercially used for more than 100 years, it has limitations, such as the requirement that the process operate at high temperatures on the order of about 970° C. Such high operating temperatures are needed to maintain alumina solubility. However, the high temperatures also result in reactions between the carbon cathode and the cryolite and molten aluminum, thereby creating problems of metal and electrolyte containment.

Various attempts have been made in the prior art to improve carbon cathodes by providing them with adherent protective coatings of refractory materials. These protective coatings generally comprise an aluminum-wettable refractory hard metal, such as titanium diboride, alone or in combination with other materials such as metal alloys, intermetallic compounds, cermets and oxides.

Some prior patents disclosing attempts at providing carbon electrodes with an aluminum-wettable coating are Foster et al U.S. Pat. No. 4,308,115; Sane et al U.S. Pat. No. 4,560,448; Boxall et al U.S. Pat. Nos. 4,466,996 and 4,624,766; Sekhar et al U.S. Pat. No. 5,310,476 and Juric et al U.S. Pat. No. 5,352,338. However, these prior art coatings each suffer from one or more serious limitations making them less than entirely suitable for their intended purpose. For example, the particularly preferred coating described in Sekhar et al U.S. Pat. No. 5,310,476 contains silicon and phosphorus compounds. Silicon and phosphorus are generally considered deleterious to efficient and economical operation of an aluminum electrolysis cell.

It is an objective of the present invention to provide a coating composition which will produce a metal-wettable coating on carbon electrodes, without including any silicon or phosphorus compounds in the composition.

A related objective of the invention is to provide a coating composition made from relatively inexpensive ingredients.

Additional objectives and advantages of my invention will become apparent to persons skilled in the art from the following detailed description.

SUMMARY OF THE INVENTION

In accordance with the present invention, there is provided an electrolysis cell comprising an anode, a carbon cathode, and a chamber containing a metal oxide dissolved in a molten salt bath. The cathode is made of a carbonaceous material, examples of which are petroleum coke, anthracite coke and graphite. Preferably, the anode is also made of a carbonaceous material. Alternatively, the anode may include a mixture of inert metal oxides with a metal.

The molten salt bath preferably comprises NaF and $AlF_3$ in a molar ratio of about 2.4:1 to 1.0:1, preferably in the molar ratio of about 2.2:1. Alternatively, the salt bath may contain a mixture of metal fluorides including NaF, $AlF_3$, KF and/or LiF.

The operating temperature may vary in the range of about 750°–980° C., and is preferably about 940°–970° C.

The metal oxide dissolved in the bath may be aluminum oxide (alumina) or magnesium oxide (magnesia). Aluminum oxide is particularly preferred.

The coating composition of the invention comprises an aluminum paint and a refractory metal source. The refractory metal source is preferably selected from the elements titanium, zirconium, hafnium and oxides of such elements. Titanium is particularly preferred.

The coating composition may also contain a boron source. Some preferred boron sources include boron oxide, boron and boron in impure form, containing up to 30 wt. % or more of magnesium.

The aluminum paint contains aluminum powder and an organic polymeric binder. The aluminum powder will generally be provided as an aluminum paste. Some preferred polymeric binders include alkyd resins, phenolic resins, acrylic resins, polystyrene and casein. Alkyd resins are particularly preferred.

The paint may also contain a solvent and an oil. Some preferred solvents are organic liquids having a boiling point up to about 220° C. Examples of suitable solvents include methanol, ethanol, isopropanol, methylethyl ketone, $C_4$—$C_{12}$ aliphatics and mixtures of such aliphatics, toluene, xylene, petroleum naphtha and mineral spirits. A mixture of aliphatics is preferred.

The oil additive may be tall oil or a drying oil. The term "tall oil" means a byproduct in the digestion of wood pulp, normally containing about 40–55 wt. % resin acids, about 40–55 wt. % fatty acids and about 5–10 wt. % unsaphonifiable material such as sterols, higher alcohols, aliphatic and aromatic hydrocarbons, and the like. The term "drying oil" refers to a vegetable or animal oil which, when applied as a thin film, readily absorbs oxygen from the air and polymerizes to form a tough, elastic film. Some preferred drying oils include tung oil, soybean oil, fish oil, linseed oil and cottonseed oil, all of which contain glycerol esters of unsaturated fatty acids such as oleic acid, linoleic acid, linolenic acid, arachidonic acid and clupanodonic acid.

A preferred coating composition contains about 15–40 vol. % of a mixture comprising a refractory metal source and a boron source, and about 60–85 vol. % of an aluminum paint. Preferably, the composition contains about 20–35 vol. % of the mixture and about 65–80 vol. % paint. More preferably, the mixture comprises about 25–30 vol. % and the paint about 70–75 vol. % of the composition. The molar ratio of boron to refractory metal in the mixture is at least about 1.2:1, preferably about 1.8:1 to 2.1:1 and optimally about 2:1.

The coating of the invention is applied onto carbon bodies. The carbon bodies are preferably electrodes used in electrolysis of a metal oxide dissolved in a molten salt bath, and more preferably are carbon cathodes. Other carbon bodies on which the coating may be used include rotor shafts and sparging nozzles for molten metal processing and carbon side walls in electrolytic cells.

In the preferred method of the invention, outer surface portions of the carbon cathode are coated with the coating composition. Preferably, both the floor and side walls are coated with a first coat or primary coat while the cell chamber is empty. Then, an overcoat or second coat of the same composition or a similar composition containing particles of a refractory material may be coated over the primary coat. The overcoat renders the primary coat less susceptible to oxidation. If desired, several such overcoats may be applied. Some suitable refractory particulates which may be added to the overcoat include alumina, aluminum borate ($Al_{18}B_4O_{33}$), calcium fluoride, titanium metal, titanium dioxide and carbon.

The coated cathode is then air dried or heated with a gas torch, to cure the coating composition into an adherent, metal-wettable coating on the cathode outer surface portion. Molten cryolite containing dissolved alumina is poured into the cell chamber, and the cell temperature is raised to about 940°–970° C. Metal is produced by conducting an electric current through the molten salt bath between the anode and the coated cathode.

A preferred coating composition containing titanium dioxide and boron oxide produces a coating on the carbon bodies which includes titanium diboride. An alternative coating composition which does not include any boron source results in a coating containing titanium carbide, usually with a non-stoichiometric ratio of titanium to carbon.

BRIEF DESCRIPTION OF THE DRAWING

The sole Figure is a schematic cross-sectional view of an electrolytic cell having a carbon cathode provided with the coating of the present invention.

DETAILED DESCRIPTION OF THE PREFERRED EMBODIMENT

There is shown in the Figure an electrolytic cell 10 including a graphite crucible 11. An open-ended alumina liner 12 inside the crucible 11 serves to insulate the side wall 13 of the crucible 11 from DC current flow. Accordingly, all electric current flows from the bottom wall 14 of the crucible 11.

A graphite plate 16 was inserted in the cell bottom. A two-inch diameter cathode stud 17 of 20 wt. % graphite and 80 wt. % coke was set in the plate 16 to serve as the primary cathode. The cathode stud 17 has a side or side wall 18 and a top or top wall 19. The top 19 of the stud 17 was machined at a 30° angle to the top surface 20 of the graphite plate 16 to establish a drained surface enhancing flow of molten aluminum away from the top 19.

The anode 25 is a two-inch diameter graphite rod, machined to have a bottom surface 26 sloping at a 30° angle to the graphite plate top surface 20. The anode bottom surface 26 is parallel to the cathode top surface 19. The graphite plate 16 and the alumina liner 12 define a cell chamber 30.

A preferred coating composition of the invention was prepared by mixing together Ti and B powders so that Ti and B are in a molar ratio of approximately 1:2. The boron powder contained about 70 wt. % B and about 30 wt. % Mg. Boron powders of 90 wt. % and 95 wt. % purity are also suitable, although more expensive than the 70 wt. % purity powder.

An amount of about 27.2 vol. % of the Ti and B powder mixture was combined with about 72.8 vol. % of an aluminum paint to form a thick slurry. The paint contained about 14 wt. % aluminum paste, about 43 wt. % nonvolatile polymeric resins and drying oils and about 43 wt. % volatile aliphatic hydrocarbons. The aluminum paste contained aluminum flakes, a volatile hydrocarbon vehicle and a surfactant, preferably a mixture of fatty acids.

The coating composition slurry was coated onto the top surface 19 and side 18 of the carbon cathode 17 and onto the top surface 20 of the graphite plate 16. A total of three coats was applied. The coated parts were dried in air overnight. If desired for faster application, the coating composition can be cured in air heated to about 150° C.

Two layers of aluminum foil were placed around the cathode stud 17 and on the bottom wall 20 to protect the coating during heat-up. A charge of 400 g Al pebbles was placed inside the cell chamber 30, and the charge was covered with three layers of aluminum foil. The remainder of the chamber 30 was filled with a mixture of cryolite and alumina. The initial charge was supplemented with 0.05 wt. % $TiO_2$ and 0.05 wt. % $B_2O_3$ which were added to minimize dissolution of the coating before electrolysis was initiated.

The cell 10 was heated up to its 965° C. operating temperature slowly over a weekend. Bath volume was adjusted, samples taken for analysis, and the anode 25 was inserted. Direct current electrolysis was started at 50 amps and 2.74 volts. As shown in the Figure, the operating cell 10 had a pad 35 of molten aluminum adjacent the cell bottom 20 and a layer 40 of molten bath covering the aluminum pad 35, cathode stud 17 and portions of the anode 25.

The anode-cathode distance was initially set at one inch. A new anode was installed each day to control the anode shape. Over the course of each day of operation, the anode was lowered in order to maintain a more constant voltage. Alumina was fed semicontinuously in 0.8 g portions every two minutes. This feed rate was adopted to match the calculated $Al_2O_3$ consumption rate for 50 amp operation, assuming 80% current efficiency. Additions of $B_2O_3$ and $TiO_2$ to the melt were made at eight-hour intervals to maintain Ti and B levels in the molten bath near saturation and thus minimize dissolution of $TiB_2$ in the coating. Additions of NaF and cryolite to the bath were made as needed to maintain composition and depth. The test was continued for 100 hours.

After 100 hours, the crucible was lifted out of the furnace and allowed to cool. An autopsy of the cell revealed that the metal pad in the chamber 30 was very well coalesced and appeared to wet both the center carbon stud 17 and the graphite surface 20 very well. The metal separated readily from the graphite plate, indicating that the bond was relatively weak and probably that the coating was inconsistent or nonexistent. However, the metal stayed firmly attached to the cathode stud 17, indicating an excellent bond to the coating. Microprobe analyses of the carbon-aluminum interface above the metal pad confirmed a thick coating containing $TiB_2$.

Anode wear did not change the shape of the anode 25 radically. A 30° slope was retained on the lower surface 26 facing the cathode top surface 19.

Another set of experiments was performed on cathode carbon bodies coated with three layers of the coating composition described above. An overcoat having one of the following compositions was applied over the third layer:

$Al_{18}B_4O_{33}$ and Al paint $Al_2O_3$ and Al paint $TiO_2$ and Al paint

Ti metal and Al paint

The coatings were cured and then all samples were heated in air at 960° C. for 24 hours along with an uncoated carbon sample. The four coated samples all showed a negligible weight change, whereas the uncoated sample was completely oxidized so that only ash remained.

Coating compositions of the invention are useful for rendering carbon bodies less susceptible to oxidation. In addition, they can be used to prevent molten electrolyte penetration into carbonaceous material.

What is believed to be the best mode of the invention has been described above. However, it will be apparent to those skilled in the art that these and other changes of the type described could be made to the present invention without departing from the spirit of the invention. The scope of the present invention is indicated by the broad general meaning of the terms in which the claims are expressed.

What is claimed is:

1. A method for producing a metal in an electrolysis cell comprising an anode, a carbon cathode, and a chamber containing a metal oxide dissolved in a molten salt bath, said method comprising:

(a) coating an outer surface portion of said cathode with a coating composition consisting of a refractory metal source, a paint comprising an organic polymeric binder and aluminum powder, and optionally an organic solvent and an oil; and optionally a boron source:

(b) curing said coating composition by heating it to an elevated temperature, producing an aluminum-wettable coating on said cathode outer surface portion; and (c) electrolyzing said metal oxide to a metal by passing an electric current in said molten salt bath between said anode and said coated cathode.

2. The method of claim 1 wherein said metal oxide is selected from the group consisting of aluminum oxide and magnesium oxide.

3. The method of claim 1 wherein said coating composition contains a boron source.

4. The method of claim 3 wherein said molten salt bath comprises aluminum oxide dissolved in a molten mixture of sodium fluoride and aluminum fluoride, said method further comprising:

(d) adding a refractory metal oxide and boron oxide to said molten salt bath, to reduce dissolution of said coating in said molten salt bath.

5. The method of claim 4, wherein said refractory metal source is selected from the group consisting of titanium and oxides thereof and said refractory metal oxide comprises titanium dioxide.

6. The method of claim 1 wherein said refractory metal source is selected from the group consisting of titanium, zirconium, hafnium and oxides thereof.

7. The method of claim 1 wherein said aluminum powder is provided as an aluminum paste.

8. The method of claim 1 wherein said binder is selected from the group consisting of alkyd resins, phenolic resins, acrylic resins, polystyrene and casein.

9. The method of claim 1 wherein said coating composition consists essentially of:

(1) about 15–40 vol % of a mixture comprising a refractory metal source and a boron source, said mixture having a molar ratio of boron to refractory metal of at least about 1.2:1: and (2) about 60–85 vol % of said paint.

10. The method of claim 9 wherein said coating composition consists essentially of about 25–30 vol % of said mixture and about 70–75 vol % of said paint.

11. The method of claim 1 wherein said coating composition has a boron:refractory metal molar ratio of about 1.8:1 to 2.1:1.

12. The method of claim 1 wherein said paint comprises an alkyd resin, a drying oil, an organic solvent and aluminum paste.

13. In a method for producing aluminum in an electrolysis cell by passing an electric current between an anode and a coated carbon cathode through a molten salt bath containing dissolved aluminum oxide, the improvement wherein said carbon cathode is coated with a coating composition consisting of:

(1) about 15–40 vol % of a mixture comprising a refractory metal source and a boron source and having a boron:refractory metal molar ratio of at least about 1.2:1: and (2) about 60–85 vol % of an aluminum paint comprising an organic polymeric binder selected from the group consisting of alkyd resins, phenolic resins, acrylic resins, polystyrene and casein; a solvent and aluminum powder.

14. The method of claim 13, further comprising curing said coating composition by heating it to an elevated temperature, producing an aluminum-wettable outer surface portion.

15. The method of claim 13, wherein said refractory metal source comprises titanium and said boron source comprises boron.

16. The method of claim 13, consisting essentially of about 25–30 vol % of said mixture and about 70–75 vol % of said paint.

* * * * *